United States Patent [19]

Leutholt et al.

[11] Patent Number: 4,847,921

[45] Date of Patent: Jul. 18, 1989

[54] PROTECTIVE HEADGEAR

[75] Inventors: Robert M. Leutholt; Brian K. Bettis, both of Sarasota, Fla.

[73] Assignee: Eye Mask, Inc., Libertyville, Ill.

[21] Appl. No.: 856,508

[22] Filed: Apr. 28, 1986

[51] Int. Cl.[4] ..... A42B 1/08

[52] U.S. Cl. ..... 2/425; 2/424; 2/206; 2/411

[58] Field of Search ..... 2/425, 410, 411, 412, 2/413, 206, 9

[56] References Cited

U.S. PATENT DOCUMENTS

| | | | |
|---|---|---|---|
| 1,080,690 | 12/1913 | Hipkiss | 2/412 |
| 2,535,434 | 12/1950 | Marietta | 2/9 |
| 2,616,081 | 11/1952 | Weaver et al. | 2/9 |
| 3,373,443 | 3/1968 | Marietta | 2/9 |
| 3,527,461 | 9/1970 | Prafer | 2/9 X |
| 3,878,563 | 4/1975 | Pulju | 2/9 |
| 4,157,090 | 6/1979 | Phillips | 2/206 X |
| 4,317,239 | 3/1982 | Bryksa | 2/411 |
| 4,412,358 | 11/1983 | Lavender | 2/412 |

*Primary Examiner*—Werner H. Schroeder
*Assistant Examiner*—Jeanette E. Chapman
*Attorney, Agent, or Firm*—Marshall, O'Toole, Gerstein, Murray & Bicknell

[57] ABSTRACT

A protective headgear for boxing and other activities involving direct violence to the head is provided which protects the eyes from direct contact of the padded thumbs and the impacts of blows. The headgear will also provide protection from serious lacerations in critical areas above and around the eyes. The headgear has a multi-layer padded band which extends across the face to cover the upper and lower perimeters of the orbits and the nasal bone. The headgear is fabricated to provide a custom fit by applying component layers to a plaster cast of the face so as to achieve a configuration which will not shift and will afford maximum protection.

13 Claims, 2 Drawing Sheets

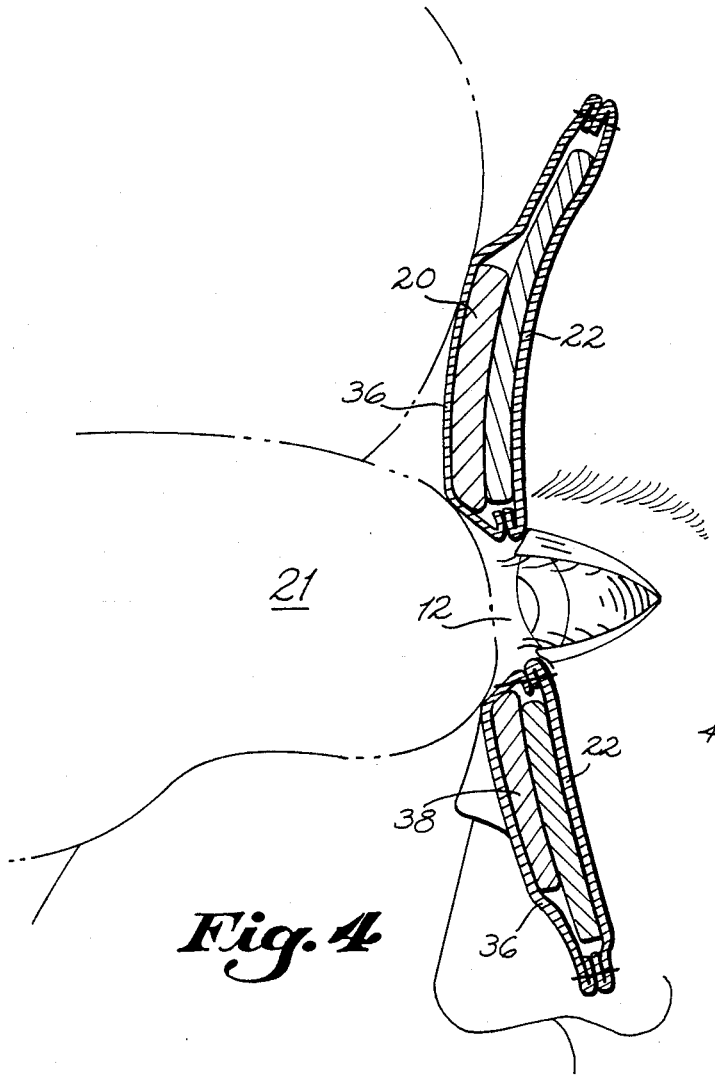
Fig. 4
Fig. 7
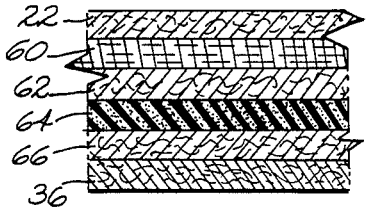
Fig. 8
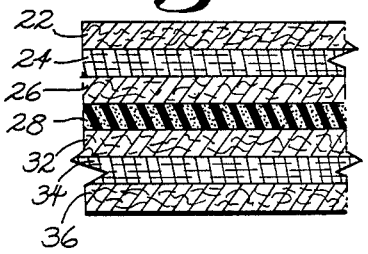
Fig. 9
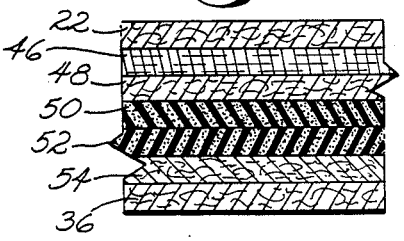
Fig. 10
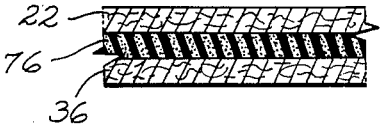
Fig. 5
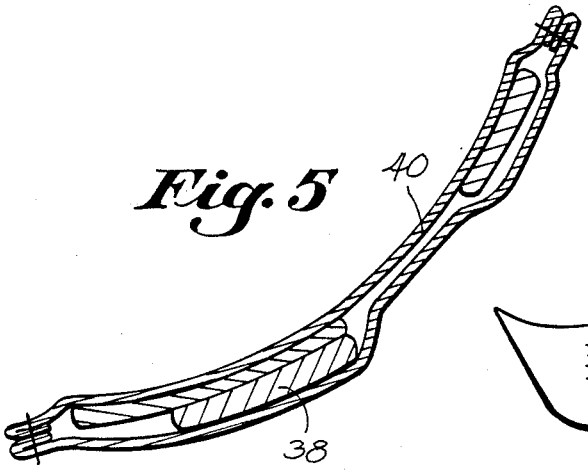
Fig. 6
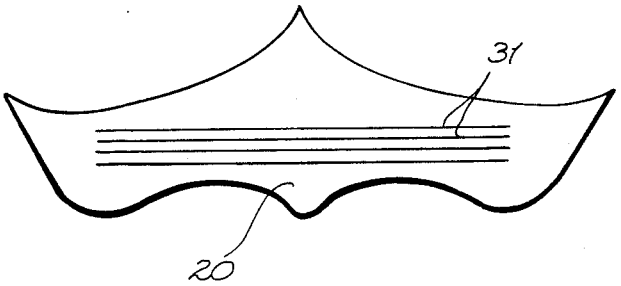

PROTECTIVE HEADGEAR

BACKGROUND OF THE INVENTION

1. Field of the Invention

This invention relates generally to headgear for protecting the head from injury, and more particularly to headgear which will protect the eyes from injury in sports such as boxing.

2. Description of Related Art

The skull and skin of the human head provide a degree of protection from injury due to minor impacts, but the head is still vunerable to more severe impacts or concentrated applications of force in localized areas. The likelihood of sustaining injury dramatically increases in certain types of activities such as boxing. The use of boxing gloves tends to spread the force of blows from the closed fist, but prudence dictates that protective headgear be used when permitted. Previously disclosed protective headgear, and the headgear which is currently used in boxing, are deficient in the protection given for the eyes. An important reason for this deficiency is that the thumb of the boxing glove can penetrate the eye openings in such protective headgear. Another important reason is inadequate protection in the form of padding from even certain blows of the closed fist portion of the boxing gloves.

U.S. Pat. No. 4,222,122, Toms, entitled: "Boxing Headguard", discloses protective headgear of a type currently used in boxing. As illustrated in FIG. 8 of this patent, the eyes of the wearer are substantially unprotected.

U.S. Pat. No. 2,458,025, Portal, entitled: "Boxer's Headgear", also shows a structure affording little protection for the eyes of the wearer.

U.S. Pat. 4,058,854, Rhee, entitled: "Protective Helmet", shows various helmet embodiments. Those embodiments illustrated in FIGS. 1–5 are said to be suitable for boxing, and the like, and provide scant protection for the eyes.

U.S. Pat. 1,887,636, Hamby, entitled: "Boxing Mask", discloses a structure intended to protect the eyes and other head areas.

The foregoing patents fail to protect the eyes of boxers adequately from injury.

It is therefore an object of this invention to provide protective headgear which will protect the eyes from direct contact with the padded thumb on a boxing glove.

It is a further object of this invention to provide protective headgear which will also protect the eyes from injury due to impact in critical areas adjacent to the eyes.

It is also an object of this invention to provide protective headgear which not only provides protection for the eyes, but also provides improved protection for other vunerable areas on the head.

It is a further object of this invention to provide improved protective headgear by a custom fit fabrication.

In accordance with these and other objects, which will become apparent hereafter, the instant invention will now be described with ,reference to the accompanying drawings.

BRIEF DESCRIPTION OF THE DRAWINGS

FIG. 4 is a cross-section taken on line 4—4 of FIG. 2; FIG. 5 is a cross-section taken of line 5—5 of FIG. 2; FIG. 6 is a detail of a portion of the padding used in the invention; FIG. 7 represents a cross-section of one type of padding used in the invention; FIG. 8 represents a cross-section of a second type of padding used in the invention; FIG. 9 represents a cross-section of a third type of padding used in the invention;

FIG. 10 represents a cross-section of a fourth type of padding used in the invention.

DETAILED DESCRIPTION OF THE INVENTION

Figure 1:
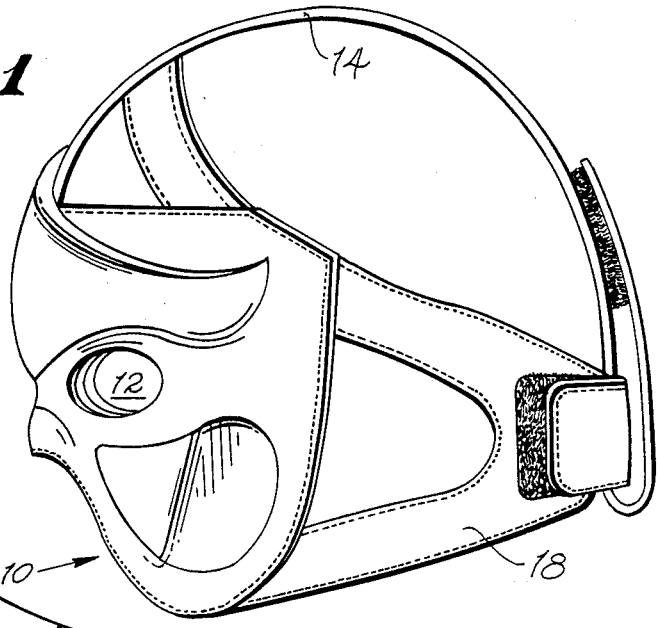
FIG. 1 represents a side elevation of a first embodiment of a protective headgear in accordance with the invention.
Figure 2:
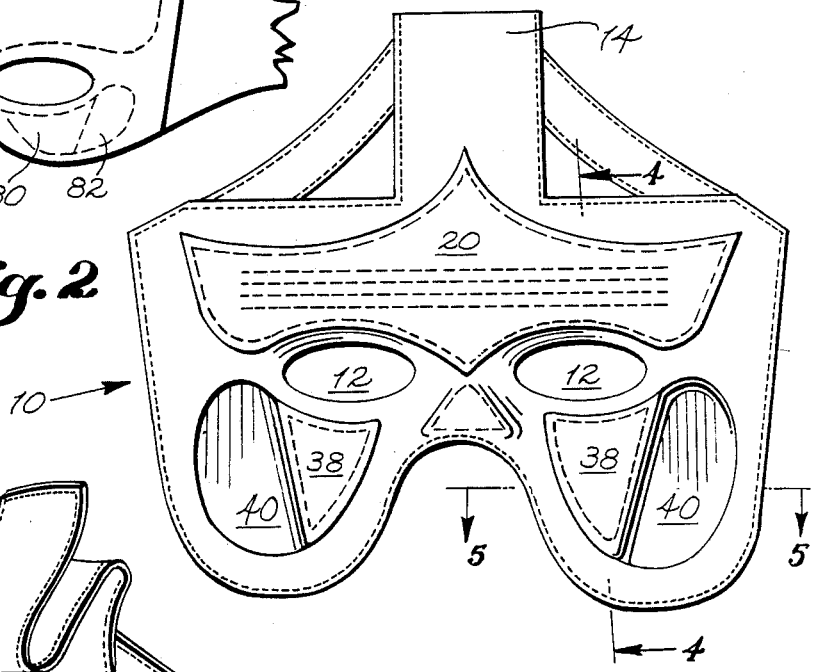
FIG. 2 is a front elevation of the headgear of FIG. 1.
Figure 3:
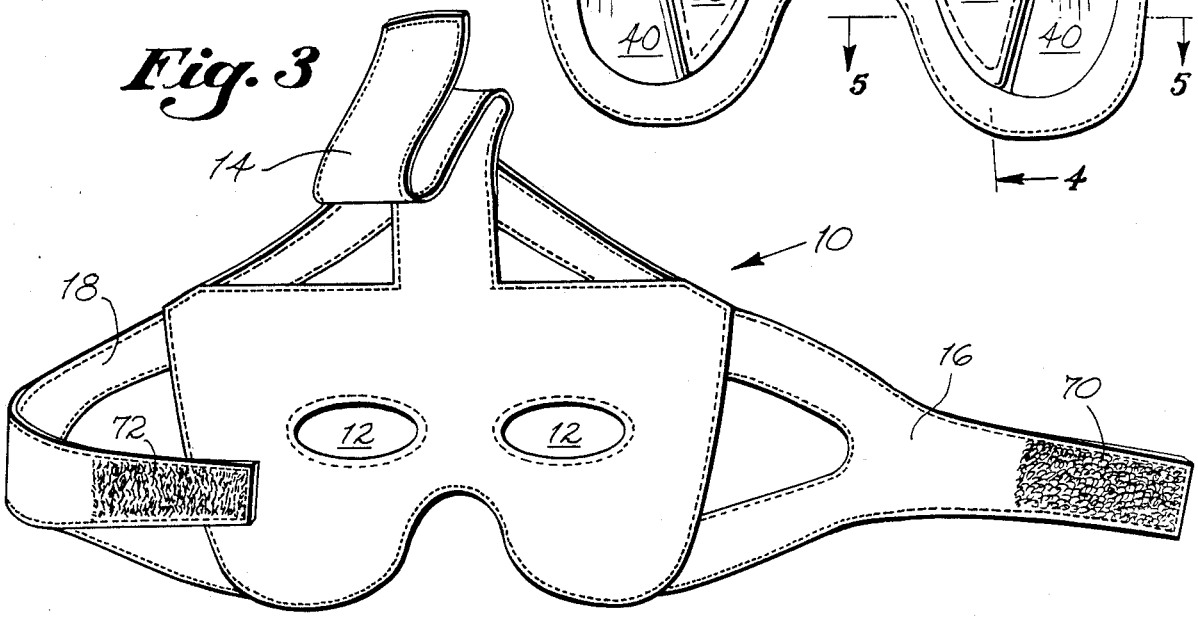
FIG. 3 is a rear developed view of the headgear of FIG. 1.

Referring to FIGS. 1, 2 and 3, protective headgear 10 is shown. The headgear is a multi-layer protective band which extends across the face and has eye openings 12, crown strap 14, and cooperating head straps 16 and 18. As will be discussed in more detail subsequently, headgear 10 has an outer layer of material which will receive the impacts from boxing gloves. Headgear 10 also has an inner layer of material which will be against the skin of the wearer. Between these inner and outer layers of material are layers of padding which over lie particular areas of the head and vary in number and kind in these different areas.

As can be seen in FIG. 2, eye openings 12 are elliptical in shape so as to be similar in configuration to, but laterally spaced from on all sides, the elliptical openings of the opened eyelids. The laterally spacing from the eyelid openings is small so that at least the upper and lower perimeters of the orbits will lie beneath the protective band. The protective band includes area 20 of a multi-layer padding. Area 20 generally over lies the portion of the frontal bone above the eyes, and in particular, the superciliary ridge of the frontal bone.

FIG. 8 shows in cross-section, the various protective layers contained in area 20. Layer 22 is orthopedic leather, i.e. leather customarily used in a prosthesis where it will be in contact with skin. Orthopedic leather has beneficial characteristics such as being nontoxic, absorbent (perspiration being a usual adjunct of boxing) and essentially non-odorous even when wet. Layer 24 is a silicone gel mat. Such a silcone gel mat is produced by I.P.O.S., U.S.A., of Lewiston, N.Y. The silicone gel mat used is 5/16ths inches thick. Layer 26 is also orthopedic leather. Layer 28 is a resilient elastomer which is liquid in its uncured state, for example the product known as Shoe Goo II, produced by Electric Products, Inc. of San Pedro, California. Layer 32 is orthopedic leather. Layer 34 is silicone gel mat. Layer 36 is kangaroo hide. Kangaroo hide is a sturdy, nonabrading, cut-resistant and flexible material. Kangaroo hide is used for boxing gloves, boxing masks, etc. because of its beneficial properties.

Referring to FIG. 6, the area 20 of multi-layer padding described before includes layer 28 of FIG. 8. This layer 28 is cut horizontally with four lines 31 to provide flexibility.

Although the materials described above with respect to FIG. 8 represent those found to have the necessary characteristics for the protective headgear of this invention, it will be evident that substitutions may be made, not only for this multilayer padding, but others used in this invention, which will still produce a satisfactory protective headgear.

Also shown in FIG. 2 are areas 38 of multi-layer insulation. Areas 38 over lie the bottom perimeters of the orbits and extend down over the malar. Areas 38 contain multi-layer insulation of the type shown in FIG. 8.

Referring to FIG. 4, a cross-section of the multi-layer band is shown. In FIG. 4, the inner and outer layers of orthopedic leather 22 and kangaroo hide 36 are shown. Only two additional layers of padding are shown for clarity in this view. The area 20 above the eye, and the area 38, below the eye, are shown to leave an opening 12 larger than the area of the eye exposed by the open eyelids. The multi-layer padding still covers the upper and lower perimeters of the orbit. A padded thumb 21, of a boxing glove is shown to be prevented from entering opening 12. In addition, it will be observed that the edges of multi-layer padding 20 and 38 which are adjacent to opening 12, slope outwardly so as not to unduly limit vision.

Adjacent to areas 38 and over lying the hollow cheek portions below the malar are padding areas 40, also shown in FIG. 2. Padding areas 40 are similar to those described in FIG. 8 with, however, the deletion of layer 28 of the elastomer.

Referring to FIG. 5, a cross-section of the multi-layer padding in areas 38 and 40, as well as the adjacent multi-layer padding are shown. Area 40 is shown as being less padded than the adjacent areas.

The ommission of the layer of padding in areas 40 has been found to relieve the excessive pressure in these areas produced by the tightness of the headgear.

Another area of padding shown in FIG. 2 is area 42. Area 42 over lies the nasal bone. FIG. 9 shows in cross-section, the various protective layers contained in area 42. Layer 22 is the inner orthopedic leather. Layer 46 is silicone gel mat. Layer 48 is orthopedic leather. Layer 50 is resilient elastomer. Layer 52 is 100% silicone rubber. The silicone rubber of layer 52 is available from Dow Corning Corporation of Midland, Michigan. Layer 54 is orthopedic leather. Layer 36 is the outer kangaroo hide.

The portion of crown strap 14 beginning immediately above padding area 20 and extending over the forehead, and the remainder of the multi-layer band extending across the face to the juncture of head straps 16 and 18 contains multi-layer padding of the type illustrated in FIG. 7. Layer 22 is the inner orthopedic leather. Layer 60 is silicone gel mat. Layer 62 is orthopedic leather. Layer 64 is resilient elastomer. Layer 66 is orthopedic leather. Layer 36 is the outer kangaroo hide. Crown strap 14 is padded to provide protection from head butts.

As seen most clearly in FIG. 3, head straps 16 and 18 have an adjustable connection arrangement 70 and 72 at their ends. In this embodiment, a plurality of hook elements 72 may be joined with loop elements 70 to form a connection. As shown in FIG. 1, crown strap 14 is provided with a similar connecting arrangement, so that it can pass beneath straps 16 and 18 and be brought snuggly up to connect upon itself. By this arrangement of crown and head straps, the protective headgear of this invention can be readily secured in position. Obviously, other adjustable fastening arrangements may be used. Because the headgear is configured so as to conform to the face, it will remain in position even while it receives the blows from boxing gloves. This assures that the padding will remain in the precise location necessary to prevent eye injuries in the Zygomatic and parietal sections, as well as preventing retina damage.

Crown strap 14 and head straps 16 and 18 also contain padding. This padding is used primarily for comfort, rather than protection. The padding used is shown in FIG. 10. Layer 22 is the inner orthopedic leather. Layer 76 is foam rubber. Layer 36 is the outer kangaroo hide. Four layers of $\frac{1}{4}$ inch foam rubber were actually used in layer 76, but after stitching, the overall thickness of the straps is less than $\frac{1}{4}$ inch.

It will be observed that the protective headgear of this invention has in all multi-layer padded areas an inner layer 22 of orthopedic leather and an outer layer 36 of kangaroo hide.

As previously indicated, variations in the type of padding may be made. One modification is the substitution of encapsulated liquid silicone for the resilient elastomer. The liquid silicone has the advantage that it may be cooled before the headgear is donned. The beneficial effects of cooling in activities such as boxing are well known.

The statement relating to making variations in the type of padding should be understood to mean only variations which will permit the objectives of the invention to be carried out. One important objective is to provide protective headgear which will closely conform to the configuration of the face of the wearer. This close configuration assures that the padding will be located at the precise locations on the face where it is needed to prevent injury. It also is important in keeping the headgear in position even while impacts are received at various locations. This close configuration is achieved by forming the mask on a plaster cast having the configuration of the face of the boxer who will war it. This plaster cast, in the most preferred form of the invention, will be of the head of the actual person for whom the protective headgear is fabricated. Thus professional and amateur boxers who will have many occasions to use the headgear will have a custom made protective headgear. The same techniques used in producing such custom protective headgear can also be used in producing headgear on plaster casts of several generic head sizes. Such headgear will not be as comfortable as a custom made headgear, but will still provide a secure fit to properly locate the padding.

The fabrication technique or process involves the use of the plaster cast (either of a particular individual or a generic plaster cast). The layers are not formed in the order in which they are shown in FIGS. 7–10, but rather in the manner which will now be described.

Uncured resilient elastomer is applied in a layer to the plaster cast face and allowed to cure. The rough outline of the face portion of the headgear is drawn on this elastomeric layer. The area identified as 40 in FIG. 2 is cut out and lines are cut horizontally across the center of the area 20. This elastomeric layer is then removed and trimmed to size.

A sheet of orthopedic leather is then drawn tightly over the plaster cast and relief lines are cut across the center of the eye openings (12 in FIG. 2) and down the center of the nose area (42 in FIG. 2). These relief lines permit the orthopedic leather to conform more closely to the rest of the plaster cast.

On the side of the elastomeric layer which was next to the plaster cast, a coating of uncured elastomer is applied and this mask placed on top of the orthopedic leather which is still on the mask. Uncured elastomer is used as an adhesive because most adhesives will not adhere to the elastomeric layer. The two layers are held tightly to the plaster cast until the adhesive dries using heavy rubber bands with pads as needed adjacent to the protruding nose and any other area where the layers would not otherwise be held tightly against the plaster cast.

The nose pad (42 in FIG. 2) of 100 per cent silicone is a very viscous liquid which is molded in place to cover the nasal bone area.

The plaster cast at this time has an outer layer of the elastomer except for the cheek area which was cut away and an extra thin layer at the nose pad. Another layer of orthopedic leather is applied on this using uncured elastomer as the adhesive. This is again held tightly in place until the adhesive dries, and is then removed.

A sheet of silicone gel mat is then laid on the plaster cast with the gauze side against the plaster cast. This material must be washed before using. While on the plaster cast, relief cuts are made in the eye hole and on the nose to permit this sheet to be drawn closely against the plaster cast. A 100 per cent silicone adhesive such as Parafound (A-863 Adhesive) available from Para-Chem Southern, Int. of Philadelphia, Pa., is applied to the silicone gel mat and the previously removed layers are placed over this and clamped to the plaster cast until the adhesive dries.

Silicone gel mat pieces coextensive with areas 20 and 38 of FIG. 2 are cut and adhesively applied using the Parafound adhesive and held in place until the adhesive dries.

The multi-layer headgear thus far formed is removed from the plaster cast. At this time the inner and outer layers are applied while off the plaster cast. The inner orthopedic leather is applied using the Parafound adhesive. The kangaroo hide is applied using Profound adhesive at the areas 20 and 38 having the silicone gel mat pieces, and uncured elastomer in the remaining area.

The straps may be assembled at this time using uncured elastomer as the adhesive to join the inner orthopedic layer, the foam rubber layers and the outer kangaroo hide. The adjustable fastening means on the straps may be secured using uncured elastomer adhesive.

The headgear is then stitched using nylon thread, and trimmed to its final configuration.

The use of orthopedic leather in some of the intermediate layers and the use of adhesives between layers provide strength and integrity as well as providing perfect memory of the form and shape of the face to the protective headgear so that the various padding layers will not shift within the headgear, nor will the interior layers tear apart. The stability of the padding is, of course needed, so that the protection afforded by the headgear will remain effective. The more precise fit provided by the custom fabricated headgear prevents shifting of the headgear on the head somewhat more effectively than headgear made to fit generic plaster casts. The custom headgear may also be more comfortable. Never-the-less, the primary functions of protecting the eyes from thumbs and punches are carried out by the non-customized headgear since the size of the padding is adequate to insure appropriate coverage even with slight shifting.

Figure 11:
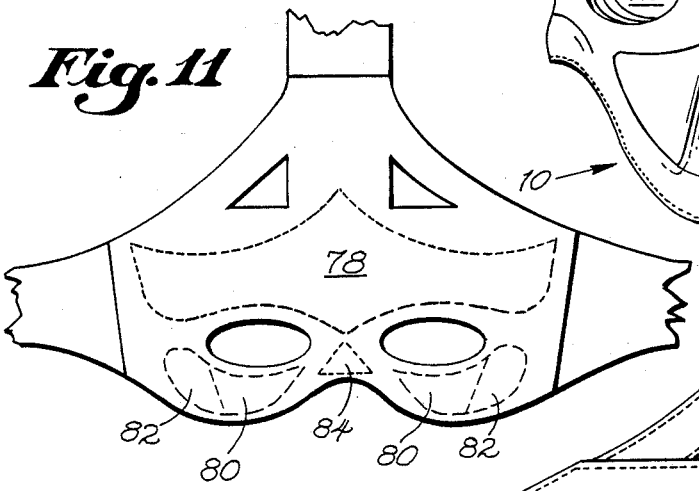
FIG. 11 represents a front elevation of a second embodiment of the protective headgear of this invention.

Referring now to FIG. 11, an alternative embodiment of the invention is shown. The configuration here is more of goggles than in the embodiment of FIG. 2. The various special areas of multi-layer padding are similar to those previously described with respect to the FIG. 2 embodiment. Thus area 78 has multi-layer padding of the type shown in FIG. 8. Areas 80 have multi-layer padding of the type shown in FIG. 8. Areas 82 have multi-layer padding of the type shown in FIG. 8 with the deletion of layer 30 of elastomer. Area 84 has multi-layer padding of the type shown in FIG. 9.

It may be noted that the headgear of this invention provides no protection for other areas of the head, such as the ears, which other boxing headgear may protect. Protection for such other areas may be added if desired, but injuries to these areas are not frequent and not likely to produce permanent handicaps.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

We claim:

1. Protective headgear comprising:

a band for extending across the face;

said band overlying at least the upper and lower perimeters of the orbits, the superciliary ridge of the frontal bone, and the nasal bone while leaving uncovered the nostrils, the mouth and the chin;

said band having an inner layer to be positioned against the face of the wearer formed of a sturdy, nonabrasive and flexible material and an outer layer formed of a sturdy, nonabrading material;

said band having at least one layer of selectively placed padding;

said selectively placed padding comprising a first padded region positioned to over lie the nasal bone, a second padded region positioned to over lie the upper and lower perimeters of the orbits and a third padded region positioned to over lie the cheeks below the malar;

said band defining a pair of elliptical openings, similar in configuration to, but laterally spaced from, the elliptical openings of the opened eyelids; and strap means for securing said protective headgear to the head.

2. Protective headgear in accordance with claim 1 wherein:

said selectively placed padding positioned to over lie the upper and lower perimeters of the orbits is layers seriatim from said inner layer to said outer layer of (1) silicone gel mat, (2) orthopedic layer, (3) elastomeric, (4) orthopedic leather, and silicone gel mat.

3. Protective headgear in accordance with claim 2 wherein:

said band is configured to conform with the face of the wearer.

4. Protective headgear in accordance with claim 1 wherein:

said inner layer is orthopedic leather and said outer layer is kangaroo hide.

5. Protective headgear in accordance with claim 1 wherein:

said selectively placed padding positioned to over lie the nasal bone is layers seriatim from said inner layer to said outer layer of (1) silicone gel mat, (2) orthopedic leather, (3) elastomeric, (4) 100% silicone rubber, and (5) orthopedic leather.

6. Protective headgear for covering the face from below the lower perimeter of the orbits to above the upper perimeter of the orbits and extending between the ears, while leaving uncovered the nostrils, the mouth and chin, comprising:

an inner layer having a conformation complementing that of a face, of a sturdy, nonabrasive, nontoxic and flexible material;

an outer layer of a sturdy, nonabrading, cut-resistent, flexible material;

said inner and outer layers defining elliptical eye openings over lying and slightly larger than the elliptical openings of the opened eyelids;

first padded regions contained between said inner and outer layers and positioned to over lie the upper and lower perimeters of the orbits; and strap means for adjustably securing said protective headgear to the head.

7. Protective headgear in accordance with claim 6 wherein:

said inner layer is orthopedic leather and said outer layer is kangaroo hide; and said first padded regions comprise layers seriatim from said inner layer to said outer layer of (1) silicone gel mat, (2) orthopedic leather, (3) elastomeric, (4) orthopedic leather, and (5) silicone gel mat.

8. Protective headgear in accordance with claim 6 further including:

a second padded region contained between said inner and outer layers and positioned to over lie the nasal bone.

9. Protective headgear in accordance with claim 8 wherein:

said inner layer is orthopedic leather and said outer layer is kangaroo hide; and layers seriatim from said inner layer to said outer layer of (1) silicone gel mat, (2) orthopedic leather, (3) elastomeric, (4) 100% silicone rubber, and (5) orthopedic leather.

10. Protective headgear in accordance with claim 6 further including:

third padded regions contained between said inner and outer layers and positioned to over lie the cheeks below the malar.

11. Protective headgear in accordance with claim 10 wherein:

said inner layer is orthopedic leather and said outer layer is kangaroo hide; and said third padded regions comprise layers seriatim from said inner layer to said outer layer of (1) silicone gel mat, (2) orthopedic leather, (3) orthopedic leather, and (4) silicone gel mat.

12. Protective headgear in accordance with claim 6 further including:

a second padded region contained between said inner and outer layers and positioned to over lie the nasal bone;

third padded regions contained between said inner and outer layers and positioned to over lie the cheeks below the malar; and fourth padded regions contained between said inner and outer layers and positioned in areas other than said first, second and third regions.

13. Protective headgear in accordance with claim 12 wherein:

said inner layer is orthopedic leather an said outer layer is kangaroo hide;

said first padded regions comprise layers seriatim from said inner layer to said outer layer of (1) silicone gel mat, (2) orthopedic leather, (3) elastomeric, (4) orthopedic leather, and (5) silicone gel mat;

said second padded region comprises layers seriatim from said inner layer to said outer layer of (1) silicone gel mat, (2) orthopedic leather, (3) elastomeric, (4) 100% silicone rubber, and (5) orthopedic leather;

said third padded regions comprise layer seriatim from said inner layer to said outer layer of (1) silicone gel mat, (2) orthopedic leather, (3) orthopedic leather, and (4) silicone gel mat; and said fourth padded regions comprise layers seriatim from said inner layer to said outer layer of (1) silicone gel mat, (2) orthopedic leather, (3) elastomeric, and (4) orthopedic leather.

* * * * *